US005862960A

United States Patent [19]

Miller et al.

[11] Patent Number: 5,862,960

[45] Date of Patent: Jan. 26, 1999

[54] AEROSOL DISPENSER

[75] Inventors: Allen D. Miller; James R. Nielsen, both of Racine, Wis.; Klaas Johannis Van Lit, Amstelveen, Netherlands

[73] Assignee: S. C. Johnson & Son, Inc., Racine, Wis.

[21] Appl. No.: 807,408

[22] Filed: Feb. 28, 1997

[51] Int. Cl.[6] ..... B65D 83/20

[52] U.S. Cl. ..... 222/325; 222/402.13

[58] Field of Search ..... 222/402.13, 402.15, 222/325

[56] References Cited

U.S. PATENT DOCUMENTS

| | | | |
|---|---|---|---|
| 2,766,072 | 10/1956 | Commarato | 222/173 X |
| 2,890,697 | 6/1959 | Van Sickle | 222/3 X |
| 2,914,222 | 11/1959 | Meshberg | 222/402.11 X |
| 2,940,641 | 6/1960 | Norrish et al. | 222/183 |
| 3,254,803 | 6/1966 | Meshberg | 222/183 X |
| 3,329,320 | 7/1967 | Braun | 222/402.13 |
| 3,506,004 | 4/1970 | Mann et al. | 222/402.13 X |
| 3,765,573 | 10/1973 | Landsman | 222/182 |
| 3,887,115 | 6/1975 | Petterson | 222/402.13 X |
| 3,934,761 | 1/1976 | Gentreau | 222/402.13 X |
| 4,200,229 | 4/1980 | Spector | 239/57 |
| 4,416,398 | 11/1983 | Knickerbocker | 222/402.13 |
| 4,662,541 | 5/1987 | Fossati | 222/402.1 X |
| 4,676,408 | 6/1987 | Speitel | 222/183 |
| 4,726,519 | 2/1988 | Muoio | 222/402.13 X |
| 4,792,062 | 12/1988 | Goncalves | 222/402.13 X |
| 4,805,839 | 2/1989 | Malek | 222/402.1 X |
| 5,263,616 | 11/1993 | Abplanalp | 222/402.13 |
| 5,358,147 | 10/1994 | Adams et al. | 222/402.13 X |
| 5,366,118 | 11/1994 | Ciammitti et al. | 222/402.11 |
| 5,586,693 | 12/1996 | De Laforcade | 222/402.13 X |

FOREIGN PATENT DOCUMENTS

| | | |
|---|---|---|
| 0 714 836 AI | 11/1994 | European Pat. Off. . |
| 196 28 055 AI | 7/1995 | Germany . |
| PCT/US95/11557 | 3/1996 | WIPO . |

*Primary Examiner*—Kenneth Bomberg
*Attorney, Agent, or Firm*—David J. Houser

[57] ABSTRACT

An aerosol dispenser and a refill cartridge therefor. The aerosol dispenser has an outer housing adapted to preferentially fit a user's hand with the front of the dispenser presented away from the user. An actuator arm is hinged to the outer housing. A refill cartridge may be removably inserted into the outer housing from beneath. The cartridge includes an aerosol can having a manually activatable valve and an upwardly directed nozzle, which extends through a nozzle port in the actuator arm when the cartridge is inserted within the outer housing. A user can activate the valve by hand by pushing the actuator arm downwardly with a finger. The outer housing is designed to be held on a level surface during such activation. The nozzle includes a longitudinally extended delivery tube in fluid communication with the pressurized material in the can. The delivery tube communicates with a longitudinally extended exit chamber having a spray orifice. The longitudinal axis of the exit chamber is angularly displaced frontwardly from the longitudinal axis of the delivery tube by an angle less than ninety degrees and sufficiently great to deflect frontwardly any otherwise upwardly spraying flow of pressurized material exiting from the spray orifice, thus directing it away from a user holding the aerosol dispenser. A method of dispensing a pressurized material is disclosed, using the aerosol dispenser and cartridge.

7 Claims, 5 Drawing Sheets

AEROSOL DISPENSER

TECHNICAL FIELD

The present invention relates generally to the field of aerosol dispensers. More particularly, the invention relates to aerosol dispensers adapted for use with a replaceable aerosol cartridge.

BACKGROUND ART

The art is generally aware of aerosol dispensers for dispensing pressurized materials into the air while the device is sitting on a table or other level surface. See Adams, U.S. Pat. No. 5,358,147, and Miller et al., PCT International Application, Publication No. WO96/08425. The device sold by S. C. Johnson & Son, Inc. of Racine, Wisconsin, under the mark "Lasting Mist®" is an example of a commercial product. This device is intended to dispense a perfume into the air as an air freshener.

The Lasting Mist® device has a body that accepts a replaceable cartridge, which a user inserts into a downwardly open cartridge receptacle. The cartridge has an aerosol can with a valve stem that communicates with an upwardly extending nozzle. The nozzle protrudes from the top of the body of the device, when the cartridge is in place, and the base of the cartridge protrudes from the base of the device. A user places the device on a table or other level surface, supported by the base of the cartridge, and presses downwardly on the body. The aerosol can is activated by downward pressure transmitted from the body to the valve stem of the aerosol can.

The Lasting Mist® device delivers a harmless perfume so that it is of no particular concern to a user if droplets of the spray land on the user. Consequently, the Lasting Mist® device sprays directly upwardly and with no provision for holding the device in any particular orientation with respect to the user. However, if insect control ingredients are included in a material that is being spayed, for example, a user might well find direct exposure to sprayed droplets to be offensive, even if the droplets were not in fact harmful.

An ongoing need still exists in the art for an aerosol dispenser that is designed to be useable while sitting on a level surface, that accepts a replaceable refill cartridge, and that delivers a spray in a pre-determined direction that is both upward and away from a user of the device.

SUMMARY OF THE INVENTION

The invention may be summarized in that an aerosol dispenser includes an outer housing having a front and a back and being adapted to preferentially fit a user's hand with the outer housing so oriented that the front is presented away from the user. An aerosol can is held by the outer housing and is adapted to contain the pressurized material to be dispensed.

The aerosol dispenser includes an upwardly extending nozzle having a longitudinally extended delivery tube in fluid communication with the pressurized material in the can. The delivery tube communicates with a longitudinally extended exit chamber having a spray orifice. The longitudinal axis of the exit chamber is angularly displaced frontwardly from the longitudinal axis of the delivery tube by an angle less than ninety degrees and sufficiently great to deflect frontwardly any otherwise upwardly spraying flow of pressurized material exiting from the spray orifice, thus directing it away from a user who is holding the aerosol dispenser. Preferably, that angle is from 20 to 40 degrees, and most preferably is from 25 to 35 degrees. The aerosol dispenser also includes valve means for controlling the release of the pressurized material into the nozzle delivery tube. The valve means is manually operable by the user.

Preferably inner surfaces of the outer housing define a cartridge chamber, and the aerosol can is a part of a replaceable cartridge that is contained in and removable from the cartridge chamber. The cartridge has a front and a back and includes the aerosol can and a sleeve that holds the aerosol can. Surfaces of the sleeve selectively interact with surfaces of the cartridge chamber to require that the cartridge be aligned from front to back with the outer housing in order to be fully insertable within the cartridge chamber. Preferably, an actuator arm is joined to the housing with a hinge. The actuator arm has a nozzle port. Both the nozzle and valve means preferably are parts of the cartridge. The nozzle extends upwardly through the nozzle port of the actuator arm when the cartridge is in place within the cartridge chamber. The valve means is actuated by downward movement of the actuator arm.

The invention alternatively may be summarized as a cartridge for use in an aerosol dispenser, the aerosol dispenser having an outer housing having a front and a back, inner surfaces of the outer housing defining a cartridge chamber. The cartridge has a front and a back, and surfaces of the cartridge are adapted to so contact surfaces of the cartridge chamber as to require that the cartridge be aligned from front to back with the outer housing in order for the cartridge to be fully insertable within the cartridge chamber. The cartridge includes an aerosol can to contain pressurized material to be dispensed. A nozzle is provided that has a delivery tube in fluid communication with the pressurized material in the can. The nozzle also has a spray orifice through which the pressurized material can escape from the delivery tube. The cartridge further includes valve means for controlling the release of the pressurized material into the nozzle's delivery tube.

The nozzle's delivery tube preferably is upwardly longitudinally extended and terminates in a longitudinally extended exit chamber in which is located the spray orifice. The longitudinal axis of the exit chamber is angularly displaced frontwardly from the longitudinal axis of the delivery tube by an angle less than ninety degrees and sufficiently great to deflect frontwardly any otherwise upwardly spraying flow of pressurized material exiting the spray orifice. Preferably, that angle is from 20 to 40 degrees, and most preferably is from 25 to 35 degrees.

Alternatively, the invention may be summarized in that a method of dispensing a pressurized material includes a first step of providing an aerosol dispensing device as just described, with a cartridge having been inserted thereinto whose aerosol can contains the pressurized material to be dispensed. The subsequent step is to manually activate the valve means for controlling the release of the pressurized material. These steps may be performed with the device resting upon a suitable level surface while held by a user's hand.

DETAILED DESCRIPTION OF THE PREFERRED EMBODIMENT

Figure 1:
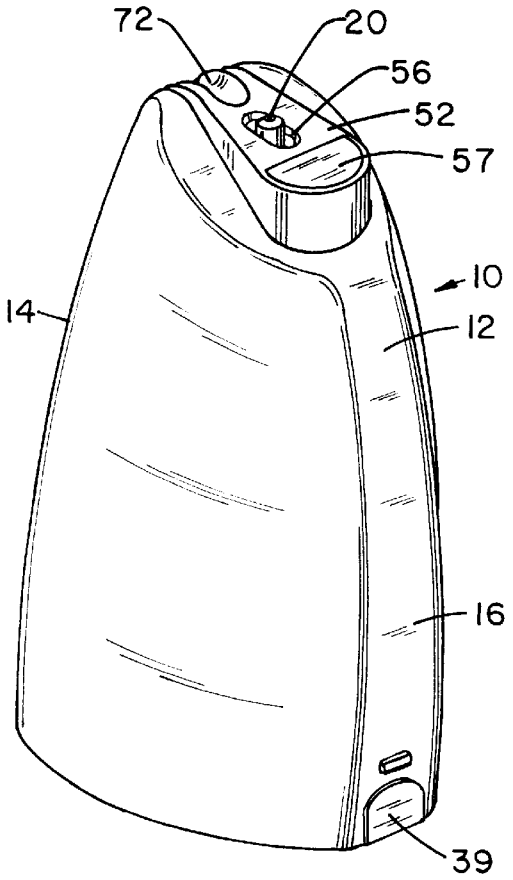
FIG. 1 is a perspective view from the back and to one side of the preferred embodiment of the aerosol dispenser of the invention.

Turning now to the drawings, wherein like parts are indicated by like reference numbers, a preferred embodiment of the aerosol dispenser of the invention is shown generally in FIG. 1 at 10. The aerosol dispenser 10 is intended to be held by the hand of the user when activated, optionally and preferably while resting on a table top or similar, generally level surface.

Figure 2:
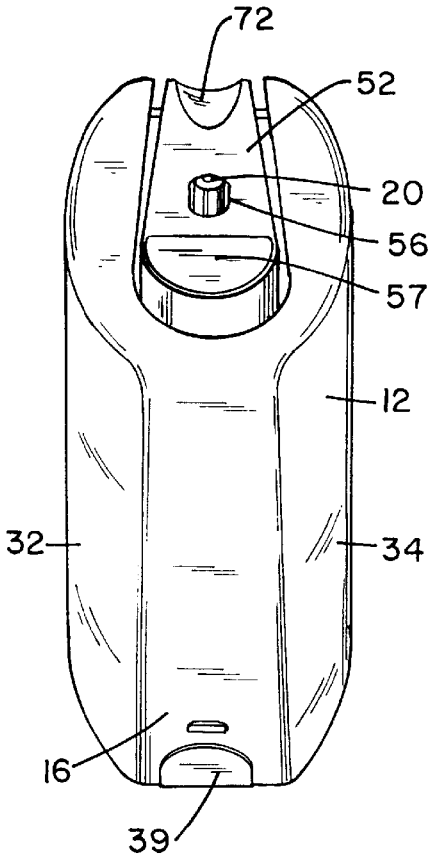
FIG. 2 is a perspective view of the aerosol dispenser of FIG. 1, from the back and above.
Figure 3:
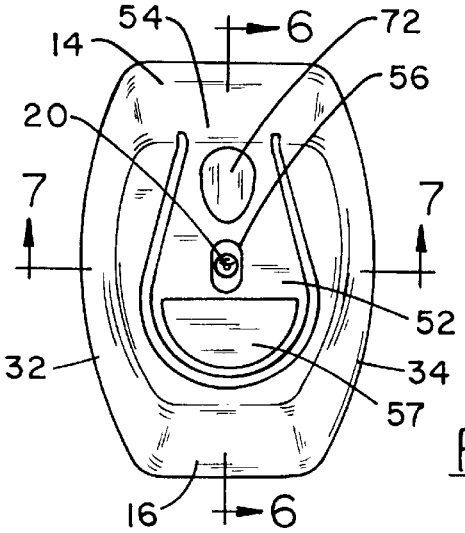
FIG. 3 is a top plan view of the aerosol dispenser of FIG. 1.
Figure 8:
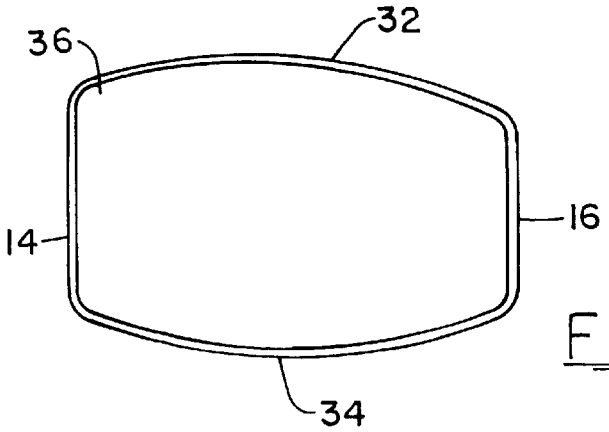
FIG. 8 is a bottom plan view of the aerosol dispenser of FIG. 1.

The aerosol dispenser 10 has an outer housing 12. The outer housing 12 has a front 14 and back 16, the outer housing being adapted to preferentially fit a user's hand with the outer housing so oriented that the front is presented away from the user. Preferably the width of the back 16 of the outer housing 12 is less than the width of the front 14 of the outer housing, to cause the outer housing to preferentially fit in the user's hand with the back of the outer housing facing toward the user. The outer housing 12 has left and right sides 32, 34. As can be easily appreciated from FIGS. 2, 3, and 8, the left and right sides 32, 34 preferably are convexly curved to comfortably fill the hand of a user and make even more natural and automatic a user's instinct to hold the aerosol dispenser 10 with the front 14 of the outer housing presented away from the user.

Figure 4:
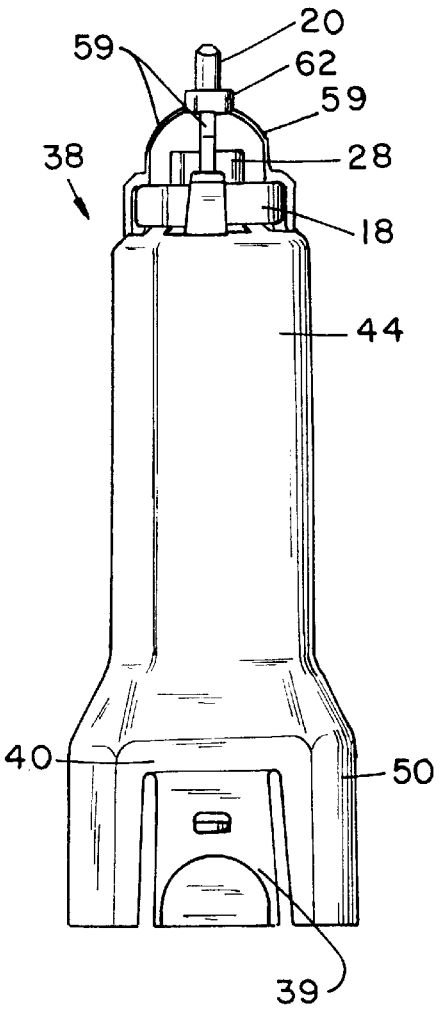
FIG. 4 is a front elevational view of the cartridge of the invention.
Figure 5:
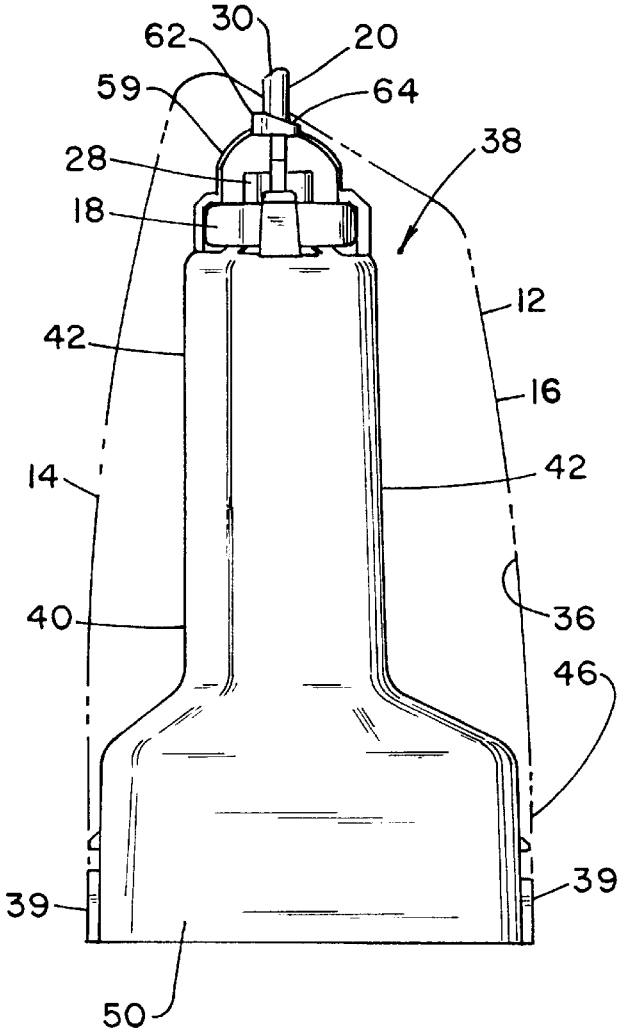
FIG. 5 is a right side elevational view of the cartridge of FIG. 4, with a silhouette of the outer housing superimposed in phantom.

An aerosol can is held by and preferably is contained within the outer housing 12. The aerosol can is adapted to contain pressurized material to be dispensed from the aerosol dispenser 10. An aerosol can is shown in FIGS. 4 and 5 at 18, incorporated in a cartridge, which is described below. Nevertheless, it is not required that the aerosol can 18 be incorporated in such a cartridge.

The aerosol dispenser 10 further includes an upwardly extending nozzle. A nozzle is shown at 20 in FIGS. 4 and 5, again as part of the cartridge just referred to, although, as with the aerosol can 18, it is not required that the nozzle form a part of such a cartridge. The nozzle 20 extends upwardly through the outer housing 12 in such a manner as to be able to deliver pressurized material from the aerosol can 18 to the atmosphere above the outer housing. The nozzle 20 has a longitudinally extended delivery tube 22, shown in FIGS. 9 and 11. The delivery tube 22 is in fluid communication with the aerosol can 18. The delivery tube 22 also communicates with a longitudinally extended exit chamber 24 at a point remote from the aerosol can 18. The longitudinal axis of the exit chamber 24 is angularly displaced frontwardly from the longitudinal axis of the delivery tube 22. A spray orifice 26 (best shown in FIGS. 9 and 11) communicates between the exit chamber 24 and the surrounding atmosphere.

Figure 11:
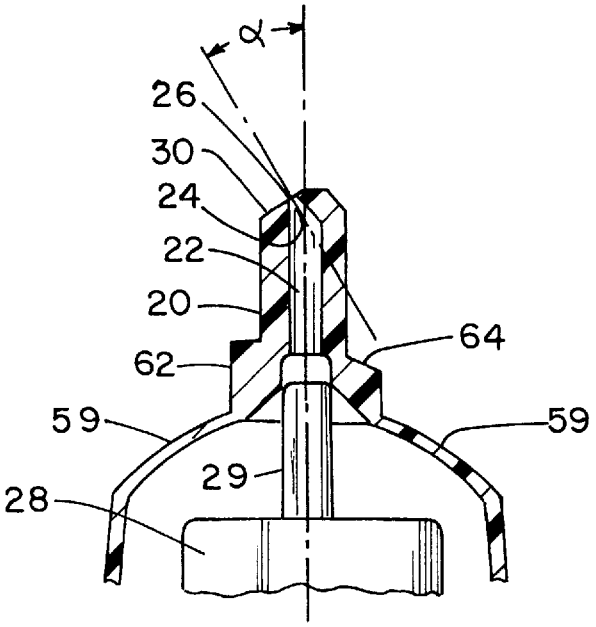
FIG. 11 is an enlarged cross-sectional view of a portion of the cartridge, as shown in FIG. 9.

The angle at which the longitudinal axis of the exit chamber 24 is displaced frontwardly from the longitudinal axis of the delivery tube 22 is shown as angle $\alpha$ in FIG. 11. Angle $\alpha$ is less than 90° and sufficiently great to deflect frontwardly any otherwise upwardly spraying flow of pressurized material exiting the spray orifice 26. Preferably, angle $\alpha$ is from 20 to 40 degrees, and most preferably is from 25 to 35 degrees. By this means, such sprayed material is directed away from a user holding the aerosol dispenser 10. Preferably the spray orifice 26 lies on the longitudinal axis of the exit chamber 24, but in any event the spray orifice 26 opens in a direction generally parallel to the longitudinal axis of the exit chamber.

Figure 9:
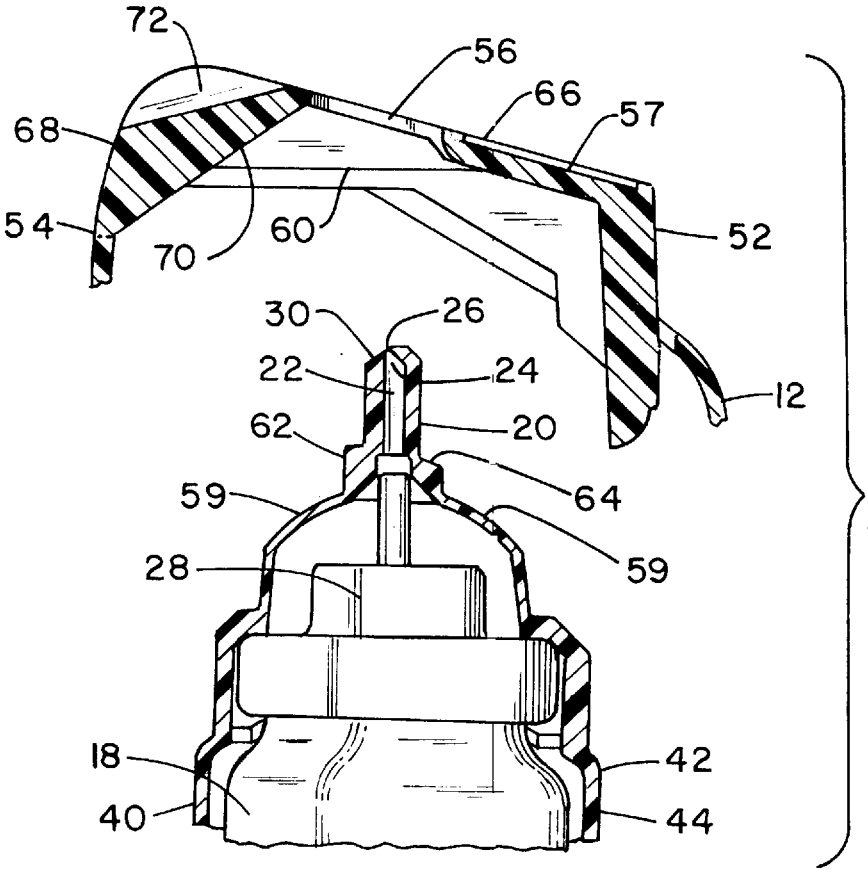
FIG. 9 is a cross-sectional view, taken from a direction corresponding to that of FIG. 6, of a truncated portion of the outer housing and actuator arm situated above the top portion of the cartridge of FIG. 5, as if the cartridge were partially inserted within the cartridge chamber, with the cartridge sleeve and nozzle shown in a cross-sectional view taken along a front-to-back mid-line of the cartridge, the aerosol can of the cartridge being shown in round.

The nozzle 20 further includes valve means for controlling the release of the pressurized material from the aerosol can 18 into the nozzle's delivery tube 22. Preferably the valve means is a conventional aerosol valve such as that shown at 28 in FIGS. 4, 5, and 9. The preferred valve 28 has a valve stem 29 that communicates with the end of the delivery tube 22 remote from the spray orifice 26, as is shown in FIGS. 9 and 11. However, other conventional aerosol valves also fall within the scope and breadth of the invention. The preferred valve 28 employed as the valve means for controlling the release of the pressurized material is a valve that delivers a single, metered discharge of pressurized material each time the valve stem 29 is pushed downwardly. In any event, the valve means is manually operable by the user of the aerosol dispenser 10.

The nozzle 20 preferably includes a frontwardly slanted tip surface 30, best shown in FIGS. 9 and 11. The spray orifice 26 is located in the slanted tip surface 30. The plane of the slanted tip surface 30 is approximately normal to the longitudinal axis of the exit chamber 24. Consequently, pressurized material spraying from the spray orfice 26 is effectively directed frontwardly, away from a user who is holding the aerosol dispenser 10 by grasping the outer housing 12 in the manner that it preferentially fits the user's hand.

Although it is possible for the aerosol can 18, nozzle 20, and related structures to be permanently mounted within the outer housing 12 of the aerosol dispenser 10 of the invention, it is preferred instead that inner surfaces of the outer housing define a cartridge chamber 36, shown in FIGS. 5–8, and that the aerosol can, nozzle, and related structures be a part of a replaceable cartridge that is removable from the outer housing. The preferred cartridge is shown generally in FIGS. 4 and 5 at 38. The cartridge 38 has a front 40 and back 42 and includes a sleeve 44 that holds the aerosol can 18. Surfaces of the sleeve 44 selectively so interact with surfaces of the cartridge chamber 36 as to require that the cartridge 38 be aligned, front to back, with the front and back of the outer housing 12 before the cartridge may be fully inserted within the cartridge chamber.

Preferably, the cartridge chamber 36 has a chamber base 46 with a downwardly open cartridge port 48 at the lowermost extreme of the outer housing 12. The cartridge 38 is removably insertable into the cartridge chamber 36 through the cartridge port 48. The cartridge 38 has a cartridge base 50, outwardly facing surfaces of which contact inwardly facing surfaces of the chamber base 46 when the cartridge is in place within the cartridge chamber 36. The cartridge 38 is retained in place within the cartridge chamber 36 by finger-releasable spring detents 39 formed on the cartridge base 50 that snap into complementary structures of the chamber base 46.

Preferably the chamber base 46 is asymmetrical from front to back, with the front 40 being wider than the back 42, in accord with the preferred shape of the outer housing 12, disclosed above. The cartridge base 50 is correspondingly asymmetrical. These corresponding asymmetries require that the cartridge 38 be insertable into the cartridge chamber 36 with only one relative orientation thereto, with the cartridge front 40 toward the front 14 of the outer housing 12 and the cartridge back 42 toward the back 16 of the outer housing. By this means, the forwardly directed spray orifice 26 consistently faces frontwardly when the cartridge 38 is in place within the outer housing 12.

Preferably the aerosol dispenser 10 includes an actuator arm 52 that is joined to the outer housing 12 with a hinge 54. Preferably the hinge 54 is a living hinge that serves also as a spring that tends to return the actuator arm 52 to its original position after it has been depressed by a user of the aerosol dispenser 10. The actuator arm 52 has a nozzle port 56 extending therethrough and preferably includes a push pad 57 that indicates the location at which a user's finger is to press on the actuator arm. Preferably, the push pad 57 is at the end of the actuator arm 52 remote from the hinge 54.

Figure 6:
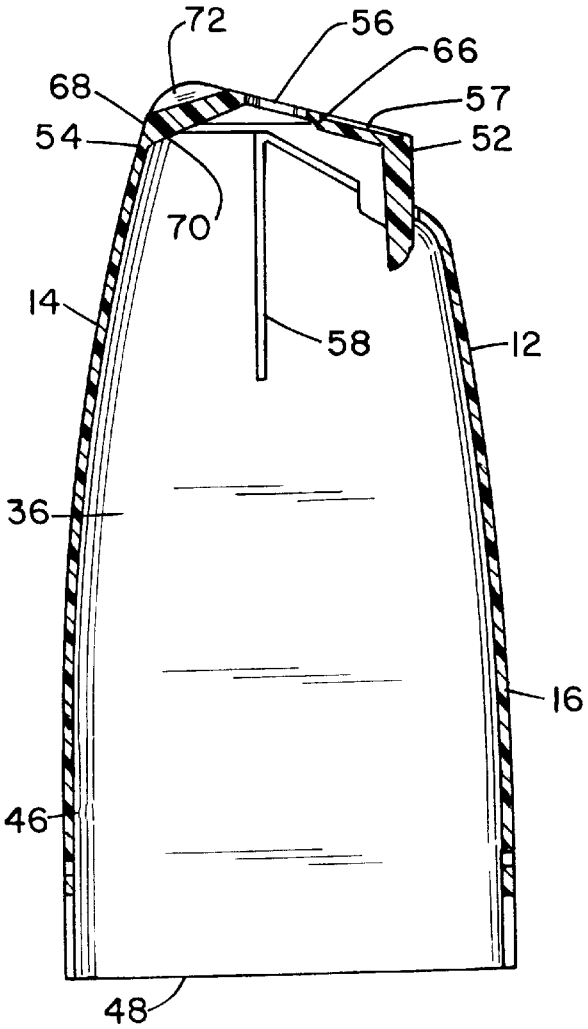
FIG. 6 is a cross-sectional view of the outer housing of the aerosol dispenser of the invention, taken along section lines 6—6 of FIG. 3 (with the cartridge removed).
Figure 7:
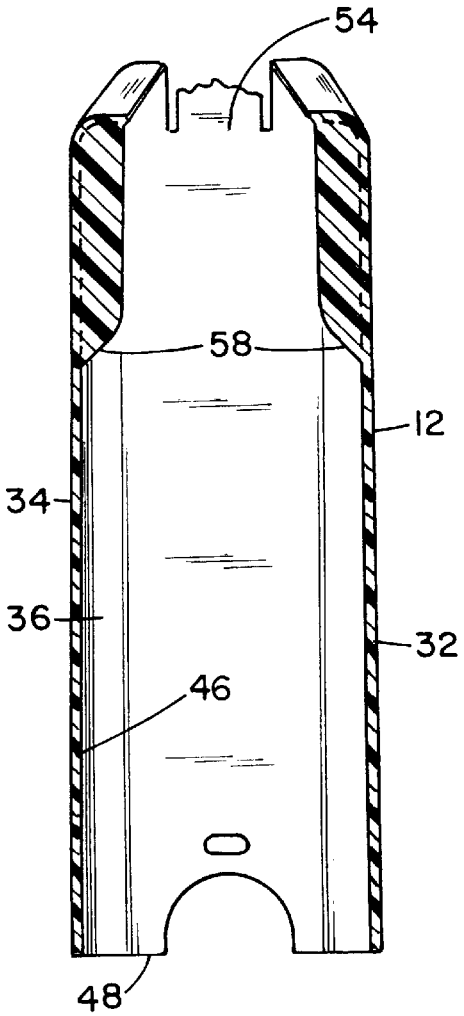
FIG. 7 is a cross-sectional view of the outer housing, taken along section lines 7—7 of FIG. 3, with the actuator arm and cartridge removed.

As has been noted, preferably the nozzle 20 and valve means, such as the valve 28, are parts of the cartridge 38. Resilient straps 59 extend upwardly from the sleeve 44 to hold the nozzle in place over the valve stem 29. The nozzle 20 is so located on the cartridge 38, and is sufficiently long, as to extend upwardly through the nozzle port 56 when the cartridge is in place within the cartridge chamber 36. Guide ribs 58 extend inwardly from the outer housing 12 into the cartridge chamber 36 to contact and position the cartridge sleeve 44 within the cartridge chamber as the cartridge 38 is inserted thereinto. By this means, as the cartridge 38 is inserted within the outer housing 12 through the cartridge port 48, the nozzle 20 is directed through the nozzle port 56 without its jamming against the underside of the actuator arm 52. The guide ribs 58 are shown in FIGS. 6 and 7.

Figure 10:
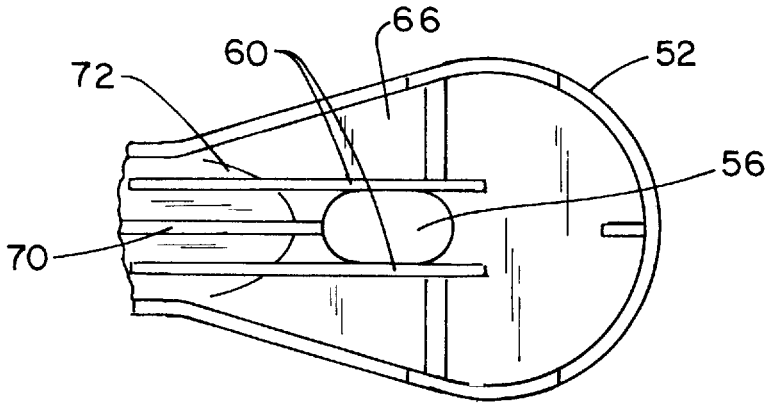
FIG. 10 is a bottom plan view of the actuator arm.

The valve means, such as the valve 28, is actuatable by downward movement of the actuator arm 52. In the preferred embodiment, the actuator arm 52 includes a downwardly facing contact surface 60 (best shown in FIGS. 9 and 10). The cartridge 38 includes an upwardly facing contact collar 62 (best shown in FIGS. 4, 5, and 9) that is immediately beneath the contact surface 60 when the cartridge is in place within the cartridge chamber 36. Downward pressure on the contact collar 62 is transmitted to the valve stem 29 and activates the valve 28. When the actuator arm 52 is depressed by a user, the contact surface 60 presses against the contact collar 62 with that result.

Preferably the hinge 54 of the actuator arm 52 is located in front of the nozzle port 56. With this arrangement, the actuator arm's contact surface 60 swings downwardly as the actuator arm 52 is depressed and presents increasingly forwardly. Upwardly facing surfaces 64 of the contact collar 62 are rearwardly canted so as to be generally aligned with the contact surface 60 of the actuator arm 52 when it is forwardly presented as the actuator arm is depressed. As a consequence of this arrangement, any lateral pressure on the nozzle 20 exerted by the actuator arm 52 is forwardly directed, with any rearwardly directed lateral pressure being avoided altogether. As a result, actuation of the valve 28 by movement of the actuator arm 52 will not cause the spray orifice 26 to be bent back toward a user. Instead, the spray orifice 26 will be pushed frontwardly, if it moves at all.

There is some advantage to minimizing the extent to which the contact surface 62 swings to present forwardly as the actuator arm 52 is depressed. Therefore, in the preferred embodiment, the actuator arm 52 includes a horizontal member 66 that extends from front to rear over the cartridge chamber 36. The contact surface 60 is located on the underside of the horizontal member 66. A vertical member 68 descends from the horizontal member 66 at a location forward of the contact surface 60, and the hinge 54 is located at the lower end of the vertical member. This arrangement is best shown in FIG. 9.

The joint between the horizontal member 66 and vertical member 68 is made rigid so that the horizontal and vertical members move together as a substantially rigid unit when the actuator arm 52 is depressed. In the preferred embodiment, this rigidity is achieved by a brace 70 (shown in FIGS. 9 and 10) and a stiffening corrugation 72 that bridges the joint. As a result, the pivot point about which the actuator arm 52 turns is solely the hinge 54. Located at the lower-most end of the vertical member 68, the pivot point is relatively low with respect to the position of the contact collar 62 when the cartridge 38 is in place within the cartridge chamber 36. This minimizes the extent to which the contact surface 60 presents forwardly as the actuator arm is depressed to the point that the contact surface touches the upwardly facing surface 64 of the contact collar 62, in turn minimizing lateral forces on the nozzle 20.

The method of the invention for dispensing a pressurized material includes the step of providing an aerosol dispenser made in accord with the previous disclosure, with the pressurized material to be dispensed contained within the aerosol can 18. A subsequent step is to manually activate the valve means for controlling the release of pressurized material, thus dispensing the pressurized material from the nozzle 20, upwardly and frontwardly directed as a consequence of the orientation of the exit chamber 24 and spray orifice 26 described above.

The method of the invention for dispensing a pressurized material includes the steps of providing the aerosol dispenser as described, above with the pressurized material contained within the aerosol can. If, as is preferred, an aerosol dispenser 10 adapted for use with a cartridge 38 is used, the method of the invention of dispensing a pressurized material includes a first step of providing such an aerosol dispenser, as described above, and inserting therein a cartridge 38 whose aerosol can 18 contains the pressurized material to be dispensed. With either alternative embodiment of the aerosol dispenser described above, a subsequent step is to manually activate the valve means for controlling the release of the pressurized material. A preferred step of the method of the invention, prior to the step of manually activating the valve means, is a step of manually holding the aerosol dispenser on a generally level surface.

The aerosol dispenser 10 may be used with any pressurized material to be dispensed but is especially valuable when it is desired to manually hold the aerosol dispenser on a generally level surface and dispense a material while minimizing direct user contact with the spray of dispensed material. Insect control active ingredients, including but not limited to repellents and insecticides, are an example of such materials. Therefore, the method of the invention of dispensing a pressurized material has special value when the pressurized material includes an insect control active ingredient.

While preferred forms of the invention have been shown in the drawings and have been described above, variations will be apparent to those skilled in the art Consequently, the invention should not be construed as limited to the specific forms shown and described. Instead, the invention should be understood in terms of the following claims.

Industrial Applicability

The practical usefulness of the aerosol dispenser and cartridge, disclosed herein, with respect to the dispensing of any materials conventionally delivered via an aerosol delivery system, including, by way of example only, air scenting or insect control active ingredients and the like, will be readily apparent to those skilled in the art. Except for the aerosol can, all the parts described may be made from any suitable plastic by conventional molding or other plastic fabrication techniques. The aerosol can may be made in conventional ways from aluminum or other suitable metals, with a conventional metered or unmetered valve.

We claim:

1. An aerosol dispenser comprising:

a. an outer housing having a front and a back, the width of the back of the outer housing being less than the width of the front of the outer housing, to cause the outer housing to fit in a user's hand with the back of the outer housing facing toward the user, b. an aerosol can held by the outer housing and adapted to contain pressurized material to be dispensed, c. an upwardly extending nozzle having i. a longitudinally extended delivery tube that is in fluid communication with the aerosol can, and ii. a longitudinally extended exit chamber having a spray orifice, the longitudinal axis of the exit chamber being angularly displaced frontwardly from the longitudinal axis of the delivery tube by an angle less than ninety degrees and sufficiently great to deflect frontwardly any otherwise upwardly spraying flow of pressurized material exiting the spray orifice, thus directing it away from a user holding the aerosol dispenser, and d. valve means for controlling the release of the pressurized material into the nozzle's delivery tube, the valve means being manually operable by the user.

2. An aerosol dispenser comprising:

a. an outer housing having a front and a back and being adapted to fit a user's hand with the outer housing so oriented that the front is presented away from the user, inner surfaces of the outer housing defining a cartridge chamber, b. an aerosol can held by the outer housing and adapted to contain pressurized material to be dispensed, the aerosol can being a part of a replaceable cartridge that is removable from the outer housing, the cartridge having a front and a back and including the aerosol can and a sleeve that holds the aerosol can, surfaces of the sleeve selectively interacting with surfaces of the cartridge chamber to require that the front and back of the cartridge be aligned with the front and back of the outer housing before the cartridge can be fully inserted within the cartridge chamber;

c. an upwardly extending nozzle having i. a longitudinally extended delivery tube that is in fluid communication with the aerosol can, and ii. a longitudinally extended exit chamber having a spray orifice, the longitudinal axis of the exit chamber being angularly displaced frontwardly from the longitudinal axis of the delivery tube by an angle less than ninety degrees and sufficiently great to deflect frontwardly any otherwise upwardly spraying flow of pressurized material exiting the spray orifice, thus directing it away from a user holding the aerosol dispenser, and d. valve means for controlling the release of the pressurized material into the nozzle's delivery tube, the valve means being manually operable by the user.

3. The aerosol dispenser of claim 1, wherein a. the cartridge chamber has a chamber base and a downwardly open cartridge port at the chamber base, b. the cartridge is removably insertable into the cartridge chamber through the cartridge port, and c. the cartridge has a cartridge base, outwardly facing surfaces of which contact inwardly facing surfaces of the chamber base, the cartridge and chamber bases being correspondingly asymmetrical to require that the cartridge be insertable into the cartridge chamber with only one relative orientation thereto.

4. The aerosol dispenser of claim 1, including an actuator arm joined to the outer housing with a hinge, the actuator arm also having a nozzle port, and wherein both the nozzle and valve means are parts of the cartridge, the nozzle extending upwardly through the nozzle port when the cartridge is in place within the cartridge chamber, and the valve means being actuatable by downward movement of the actuator arm.

5. The aerosol dispenser of claim 4, wherein guide ribs extend inwardly from the outer housing into the cartridge chamber to contact and position the cartridge sleeve within the cartridge chamber as the cartridge is inserted thereinto to direct the tip of the nozzle through the nozzle port without its jamming against the actuator arm.

6. The aerosol dispenser of claim 4, wherein a. the actuator arm includes a downwardly facing contact surface that actuates the valve when the actuator arm is depressed, the hinge of the actuator arm being located in front of the nozzle port so that the contact surface swings down and presents increasingly forwardly as the actuator arm is depressed; and b. the cartridge includes a contact collar that receives the actuator arm contact surface when the actuator arm is depressed, upwardly facing surfaces of the contact collar being rearwardly canted to align with the contact surface when it is forwardly presented as the actuator arm is depressed to avoid rearwardly directed lateral pressure on the nozzle.

7. The aerosol dispenser of claim 4, wherein the actuator arm includes a. a horizontal member on the under side of which a contact surface is located that actuates the valve when the actuator arm is depressed, and b. a vertical member descending from the horizontal member at a location forward of the contact surface, the hinge being located at the lower end of the vertical member.

* * * * *